US008075242B2

(12) United States Patent
Yoshikawa

(10) Patent No.: US 8,075,242 B2
(45) Date of Patent: Dec. 13, 2011

(54) WORKING MACHINE WITH STRUCTURE FOR ASSEMBLING BOOM THEREOF

(75) Inventor: Takuya Yoshikawa, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 193 days.

(21) Appl. No.: 12/425,755

(22) Filed: Apr. 17, 2009

(65) Prior Publication Data

US 2009/0304484 A1 Dec. 10, 2009

(30) Foreign Application Priority Data

Jun. 4, 2008 (JP) ..... 2008-147350

(51) Int. Cl.
*E02F 3/42* (2006.01)

(52) U.S. Cl. ..... 414/694; 29/33 R; 29/891; 29/897.2; 414/680

(58) Field of Classification Search ..... 414/680, 414/694, 722, 723; 172/272; 37/417, 468; 29/33 R, 891, 897.2
See application file for complete search history.

(56) References Cited

U.S. PATENT DOCUMENTS

| | | | | |
|---|---|---|---|---|
| 4,360,311 | A * | 11/1982 | Dufour | 414/687 |
| 5,484,250 | A * | 1/1996 | Gilmore et al. | 414/723 |
| 7,419,350 | B2 * | 9/2008 | Lombardo et al. | 414/685 |

FOREIGN PATENT DOCUMENTS

| | | |
|---|---|---|
| JP | 64-28452 | 2/1989 |
| JP | 2535667 | 2/1997 |

* cited by examiner

*Primary Examiner* — Donald Underwood
(74) *Attorney, Agent, or Firm* — Oblon, Spivak, McClelland, Maier & Neustadt, L.L.P.

(57) ABSTRACT

Bosses extending in the boom width direction are provided in a front end part of a main boom body rotated upward, and hooks opening downward are provided in a base end part of an extension boom body rotated downward. The above hooks and the bosses are arranged so as to satisfy a condition that at the time of second relative rotation by a two-step pin hole matching method of matching pin holes in order from the upper side and with a different center, the hooks and the bosses are moved away from each other while lower pin holes are matched with each other.

2 Claims, 9 Drawing Sheets

WORKING MACHINE WITH STRUCTURE FOR ASSEMBLING BOOM THEREOF

BACKGROUND OF THE INVENTION

1. Field of the Invention

The present invention relates to a working machine to which a structure for assembling a division type boom is installed.

2. Description of the Related Art

An attachment of a working machine for demolishing buildings, collecting and loading rubble, crushing stones and the like is replaced by other attachment which has a different specification in accordance with a work object (such as demolition, rubble collection and loading), work height (such as a high place and a low place) and the like (refer to Japanese Utility Model Laid-Open No. Sho64-28452).

For example, when a demolition work or the like is performed on a low rise structure, a first attachment A1 having a fundamental separate specification which is a basic specification shown in FIG. 11A is used. When the demolition work or the like is performed on a middle rise structure, a second attachment A2 having an extension separate specification shown in FIG. 11B is used.

As a common configuration among both the first and second attachments A1 and A2, an arm 2 is attached to a front end of a boom 1, a working device (a crusher shown in the figure or a backhoe bucket) 3 is attached to a front end of the arm 2, and a base end part of the boom 1 is attached to a base machine B so as to be raised and lowered around a boom foot pin 4.

The reference numeral 5 denotes a first boom cylinder (a raising and lowering cylinder) provided between the base machine B and the boom 1 for raising and lowering the entire attachment. The reference numeral 6 denotes an arm cylinder provided between the boom 1 and the arm 2 for rotating the arm 2. The reference numeral 7 denotes a working device cylinder provided between the arm 2 and the working device 3 for rotating the working device 3.

In the case of the first attachment A1 in FIG. 11A, the boom 1 is formed by a main boom body 8 on the base end side, and a front boom body 10 coupled to a front end of the main boom body 8 to rotate around a horizontal pin (hereinafter, referred to as a rotation spindle) 9. The front boom body 10 is rotated and folded into a reverse V shape by a second boom cylinder 11 provided between both the boom bodies 8 and 10.

In the second attachment A2 in FIG. 11B, one or more extension boom body 12 (a description will be given to a case of a single extension boom body shown in the figure) is fixed and connected to the main boom body 8 of the first attachment A1 with horizontal pins 13 and 14 on the upper and lower sides in a state that the boom is horizontal. The extension boom body 12 and the front boom body 10 are coupled to each other by the rotation spindle 9, and the second boom cylinder 11 is attached between the extension boom body 12 and the front boom body 10.

A structure of connecting the main boom body 8 and the extension boom body 12 at the time of assembling the second attachment A2 in FIG. 11B or at the time of replacing the first attachment A1 by the second attachment A2 in such a working machine is already shown in Japanese Utility Model No. 2535667.

A description will be given to the above conventional technique with FIGS. 12 to 15.

Upper pin holes 15 and 16 are provided in an upper part of a front end of the main boom body 8 and an upper part of a base end of the extension boom body 12 (the upper parts are on the upper side in a state that the boom is horizontal, the direction hereinafter is all the same), and lower pin holes 17 and 18 are provided in lower parts thereof.

A hook 19 opening upward is provided nearer to the front end than the upper pin hole 15 in a front end part of the main boom body 8. Meanwhile, a boss (normally, a round pin) 20 horizontally extending in the boom width direction is provided on an outer surface nearer to the front end than the upper pin hole 16 in a base end part of the extension boom body 12.

It should be noted that both the boom bodies 8 and 12 are formed into a box shape and symmetrically connected by pins on both the left and right sides of ends thereof. Therefore, the pin holes 15 to 18, the hook 19 and the boss 20 are provided on both the left and right sides respectively. However, in the description of the above conventional technique and a description of embodiments mentioned later, the left and right will not be distinguished for simplification.

Connection processes for both the boom bodies 8 and 12 are as follows.

(i) As shown in FIG. 12, the main boom body 8 is attached to the base machine B, while the extension boom body 12 is supported on mounts 21 in a state that the boss 20 is horizontal. The figure shows a case where the extension boom body 12 is supported on the mounts 21 in a state that other attachment elements including the extension boom body 12 (a second boom body cylinder, an arm cylinder and a working device cylinder are omitted) are already assembled.

(ii) The base machine B is moved and the hook 19 is engaged with the boss 20 from the lower side as shown in FIG. 13. In the above stage, the upper and lower pin holes 15 to 18 are not matched with each other.

(iii) The first boom cylinder 5 is elongated in the above state and the main boom body 8 is rotated upward (a scooping action).

By the above scooping action, the extension boom body 12 is rotated in the gradually lowering direction (downward rotation) around the boss 20. Therefore, the upper pin holes 15 and 16 and the lower pin holes 17 and 18 are matched with each other.

(iv) As shown in FIG. 14, the upper pin 13 is inserted into the matched upper pin holes 15 and 16, and the lower pin 14 is inserted into the lower pin holes 17 and 18 so as to connect both the boom bodies 8 and 12 to each other.

However, according to the above conventional technique, there is a need for bringing the hook 19 and the boss 20 into contact with each other as shown in FIG. 14 in a state that the upper pin holes 15 and 16 and the lower pin holes 17 and 18 are matched with each other (a connection state). Therefore, at the stage after removing the mounts 21 or at the time of work after assembling, an attachment load is imposed not only on both the pins 13 and 14 but also on an engagement part between the hook 19 and the boss 20. As a result, there is a problem that the hook and the boss are broken.

In order to prevent the problem, as shown in FIG. 15, positional relationships between the hook 19 and the boss 20 and the pin holes 15 and 16 and the pin holes 17 and 18 have to be set so as to generate a clearance C in the engagement part between the hook 19 and the boss 20 in a state that the upper pin holes 15 and 16 and the lower pin holes 17 and 18 are matched with each other.

However, when the positional relationships are set as above, the pin holes 15 and 16 and the pin holes 17 and 18 are taken away from an arc around a center of the boss at the time of the scooping action in FIG. 13. Therefore, the pin holes 15 and 16 and the pin holes 17 and 18 are not matched with each other only by the scooping action. Thus, pin hole matching becomes troublesome and hence it is not possible to sufficiently achieve an initial object of simplifying the pin hole matching with the hook 19 and the boss 20.

It should be noted that as another method, the upper pin holes may be matched by first relative rotation around the boss 20, and the lower pin holes may be matched by second relative rotation around the upper pin 13 (the pin holes are matched in order from the upper side and with a different center, the above method will be referred to as a two-step pin hole matching method hereinafter). However, according to the conventional technique, the hook 19 is moved upward and the boss 20 is moved downward at the time of the second relative rotation so that the hook 19 and the boss 20 are abutted with each other. Therefore, it is not possible to perform rotation itself.

SUMMARY OF THE INVENTION

It is an object of the present invention to provide a working machine with a structure for assembling a boom thereof capable of preventing abutment between hooks and bosses at the time of second relative rotation around an upper pin even by a two-step pin hole matching method so as to easily match pin holes, and ensuring a clearance between the hooks and the bosses in a connection state so as to prevent breakage of the hooks and the bosses.

The present invention is a working machine with a structure for assembling a boom thereof, the structure comprising a first boom body, a second boom body connected to a front end part of the first boom body rotated by a first boom cylinder with pin holes and pins on both upper and lower sides in a state that the boom is horizontal, and bosses provided in the front end part of the first boom body so as to extend in the boom width direction. Further, the bosses, and hooks formed in a base end part of the second boom body and opening downward, are arranged so as to satisfy the following conditions respectively:

(A) both the boom bodies are relatively rotated around a center of the bosses by a scooping action of rotating the first boom body upward by the first boom cylinder in a state that the bosses are engaged with the hooks, and the upper pin holes of the boom bodies are matched with each other by the above relative rotation; and (B) by rotating the first boom body upward in a state that the upper pins are inserted into the matched upper pin holes, the second boom body is rotated downward around the upper pins, and the hooks are moved away from the bosses while the lower pin holes of the boom bodies are matched with each other.

According to the present invention, the bosses are provided in the first boom body rotated upward (a main boom body) and the hooks opening downward are provided in the second boom body rotated downward (an extension boom body) so as to satisfy a specific condition that the hooks and the bosses are moved away from each other while the lower pin holes are matched with each other at the time of the second relative rotation by the two-step pin hole matching method. Therefore, it is possible to easily match the upper and lower pin holes by the two-step pin hole matching method.

Since the clearance can be ensured between the bosses and the hooks in the connection state, it is possible to prevent the breakage of the bosses and the hooks due to an attachment load at the time of work and the like.

DESCRIPTION OF THE PREFERRED EMBODIMENTS

Figure 1:
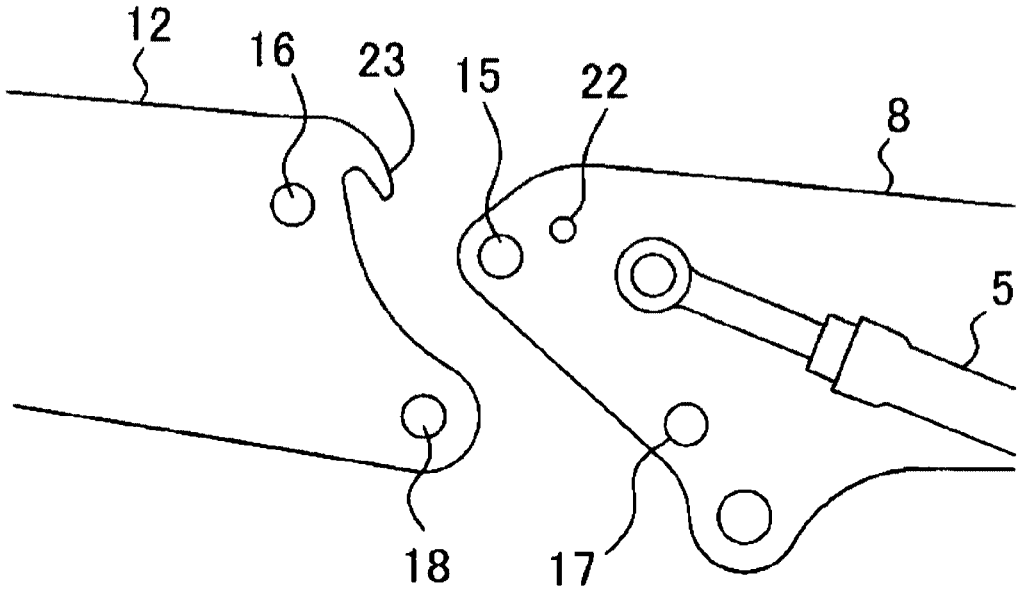
FIG. 1 is a side view showing a state that a main boom body and an extension boom body are not yet connected to each other in a first embodiment of the present invention.

A description will be given to embodiments of the present invention with FIGS. 1 to 10.

In the following embodiments, the same parts as in a demolition machine shown in FIG. 11 and a conventional technique shown in FIGS. 12 to 15 are given the same reference numerals and a duplicated description thereof will be omitted.

First Embodiment

Refer to FIGS. 1 to 5

Figure 11A:
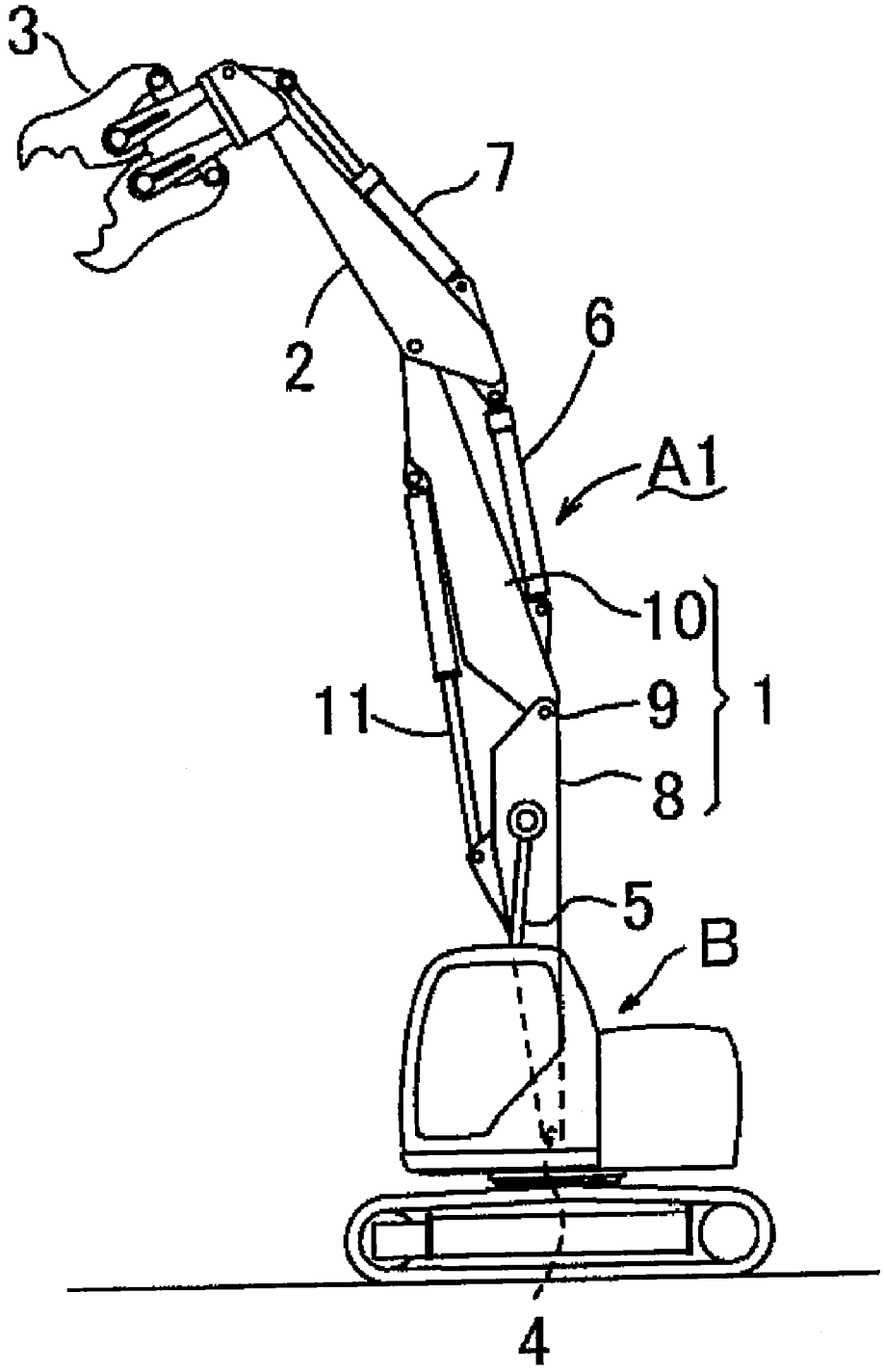
FIG. 11A PRIOR ART
FIG. 11A is a schematic side view showing a demolition machine having a fundamental separate specification.
Figure 11B:
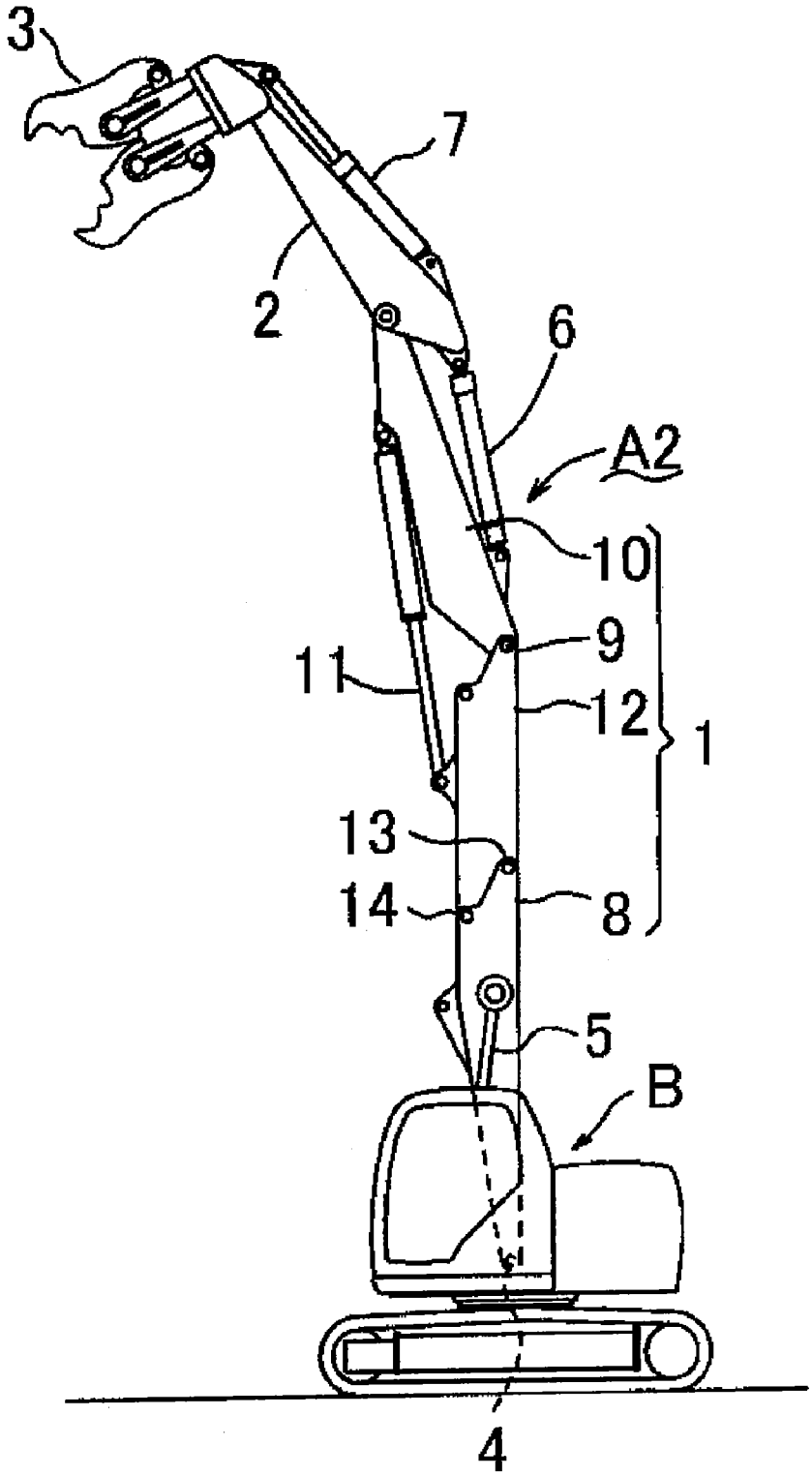
FIG. 11B PRIOR ART
FIG. 11B is a schematic side view showing a demolition machine having an extension separate specification.

A first embodiment shows an example that an extension boom body 12 is connected to a main boom body 8 in a second attachment A2 having an extension separate specification shown in FIG. 11B.

Upper pin holes 15 and 16 are provided in an upper part of a front end of the main boom body 8 and an upper part of a base end of the extension boom body 12, and lower pin holes 17 and 18 are provided in lower parts of both the bodies. An upper pin 13 is inserted into the upper pin holes 15 and 16, and a lower pin 14 is inserted into the lower pin holes 17 and 18 so as to connect both the boom bodies 8 and 12 to each other.

In the present embodiment, a boss (normally, a round pin) 22 horizontally extending in the boom width direction is provided on an outer surface nearer to the base end than the upper pin hole 15 in a base end part of the main boom body 8. Meanwhile, a hook 23 opening downward is provided nearer to the base end than the upper pin hole 16 in a base end part of the extension boom body 12.

A description will be given to connection processes for both the boom bodies 8 and 12 according to the present embodiment.

Figure 2:
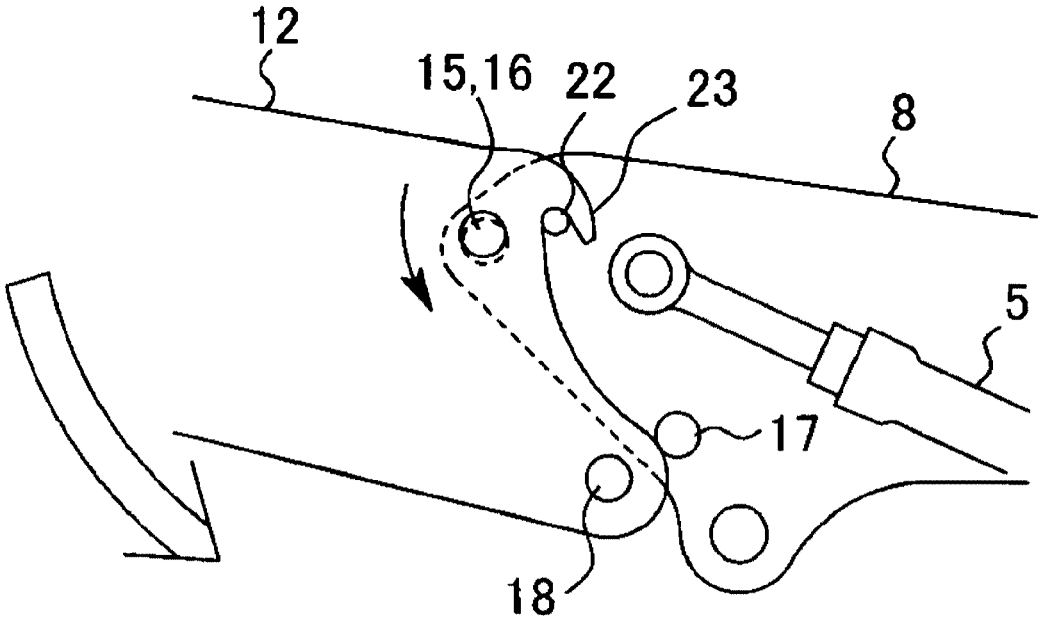
FIG. 2 is a side view showing a state that a boss and a hook are engaged with each other from the state in FIG. 1.
Figure 12:
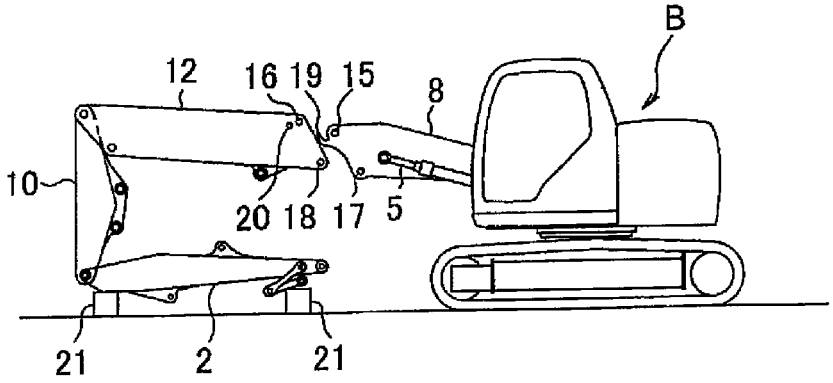
FIG. 12 PRIOR ART
FIG. 12 is a side view showing a state that a main boom body and an extension boom body are not yet connected to each other in a conventional technique.

(I) As well as FIG. 12, in a state that the main boom body 8 is attached to a base machine, and the extension boom body 12 is supported on mounts, the base machine is moved, and the boss 22 is engaged with the hook 23 from the lower side as shown in FIG. 2. In the above stage, the upper and lower pin holes 15 to 18 are not matched with each other.

(II) A first boom cylinder 5 is elongated in the above state and the main boom body 8 is rotated upward (a scooping action).

Figure 3:
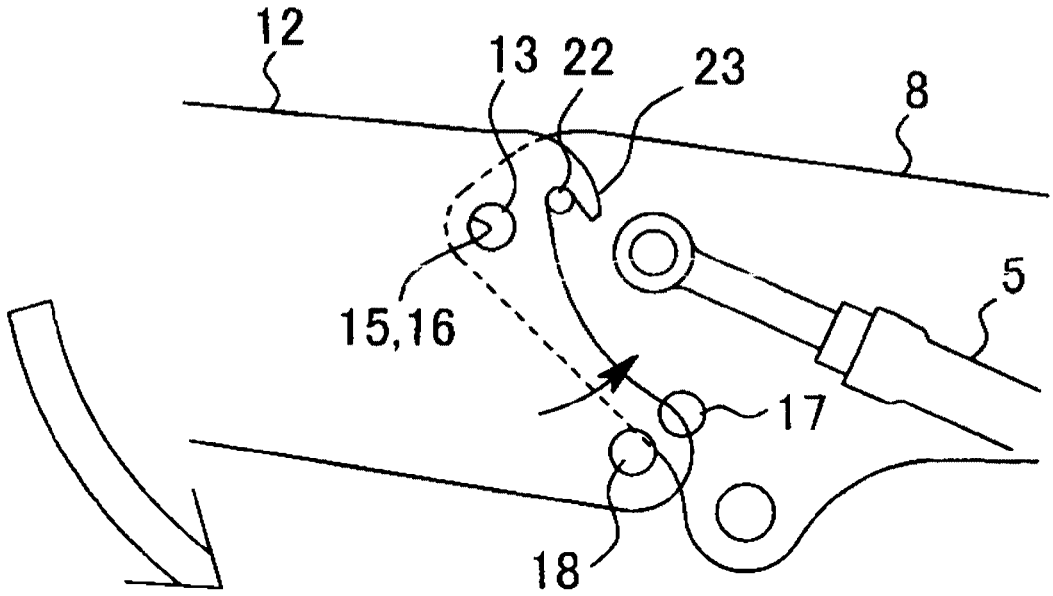
FIG. 3 is a side view of a state that upper pin holes are matched with each other by a scooping action from the state in FIG. 2.

By the above scooping action, as shown in FIGS. 2 and 3, the extension boom body 12 is rotated in the gradually lowering direction (downward rotation) around the boss 22. Thereby, the upper pin holes 15 and 16 are firstly matched with each other.

(III) The upper pin 13 is inserted into the matched upper pin holes 15 and 16 so as to connect both the boom bodies 8 and 12 on the upper side of ends thereof.

Figure 4:
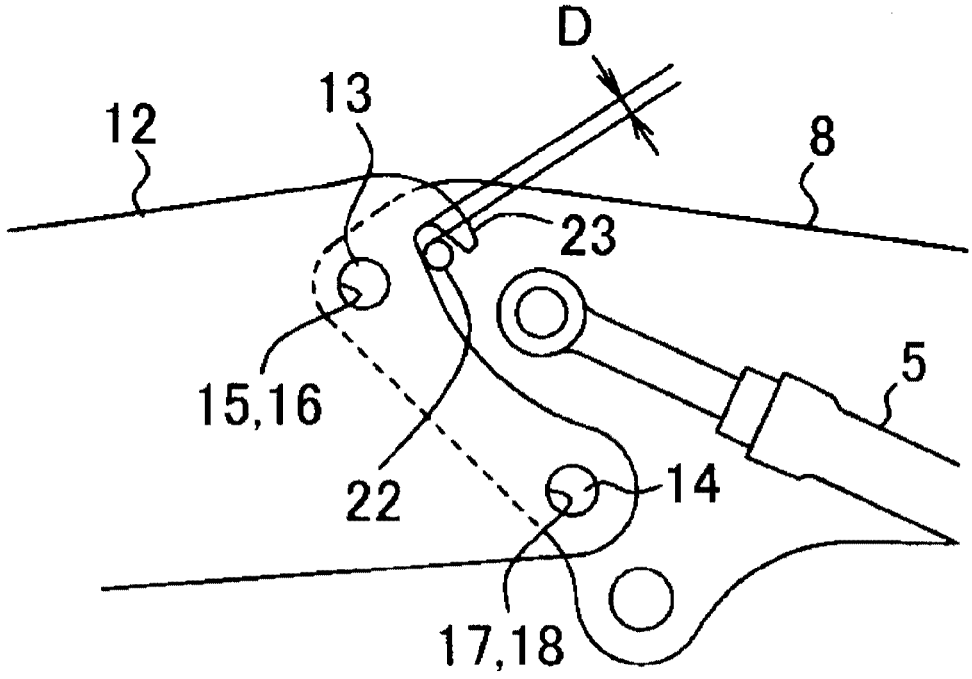
FIG. 4 is a side view showing a state that lower pin holes are matched with each other by the scooping action further from the state in FIG. 3 and a lower pin is inserted so as to complete connection.
Figure 5:
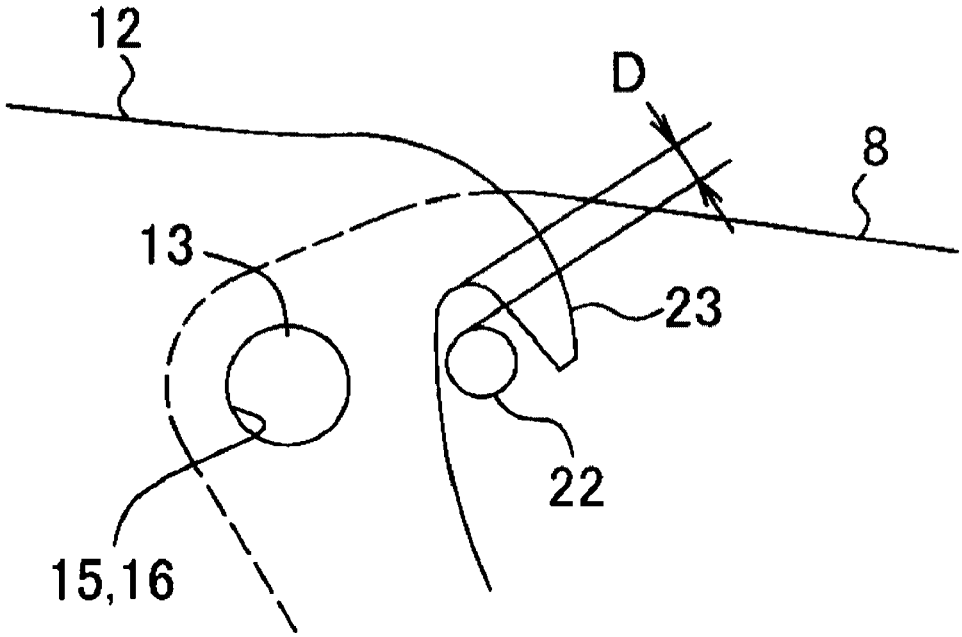
FIG. 5 is a partially enlarged view of FIG. 4.

(IV) Then, as shown in FIGS. 3 and 4, the scooping action is performed by elongating the first boom cylinder 5 again. Thereby, the extension boom body 12 is rotated downward around the upper pin 13 (accurately speaking, a center of the upper pin 13) so as to match the lower pin holes 17 and 18.

Here, as shown in FIG. 4, the hook 23 is moved to the upper side away from the boss 22 so as to generate a clearance D between both the hook and the boss in a state that the pin holes are matched with each other.

(V) The lower pin 14 is inserted into the matched lower pin holes 17 and 18 so as to complete the connection of both the boom bodies 8 and 12.

As mentioned above, both the boom bodies 8 and 12 are connected to each other by a two-step pin hole matching method of matching the pin holes in order from the upper side and with a different center.

In other words, in order to apply the above two-step pin hole matching method, the boss 22 is arranged in the main boom body (a first boom body) 8 rotated upward, and the hook 23 opening downward is arranged in the extension boom body (a second boom body) 12 rotated downward respectively so as to satisfy the following conditions:

(A) both the boom bodies 8 and 12 are relatively rotated around the boss 22 by the scooping action, and the upper pin holes 15 and 16 of the boom bodies are matched with each other by the above relative rotation (the upper pin holes 15 and 16 are positioned on an arc around a center of the boss); and (B) when the extension boom body 12 is rotated downward around the upper pin 13 in a state that the upper pin 13 is inserted into the matched upper pin holes 15 and 16, the hook 23 is moved away from the boss 22 while the lower pin holes 17 and 18 of the boom bodies are matched with each other (the lower pin holes 17 and 18 are positioned on an arc around a center of the upper pin).

According to the above assembling structure, it is possible to easily match the upper and lower pin holes by the two-step pin hole matching method.

Since the clearance D can be ensured between the boss 22 and the hook 23 in a connection state, it is possible to prevent breakage of the boss and the hook due to an attachment load at the time of work and the like.

A front boom body 10 shown in FIGS. 11A and 11B is connected to rotate around a rotation spindle 9 relative to the main boom body 8 in a first attachment A1 having a fundamental separate specification or relative to the extension boom body 12 in the second attachment A2 having the extension separate specification with a single pin (the rotation spindle 9).

Figure 13:
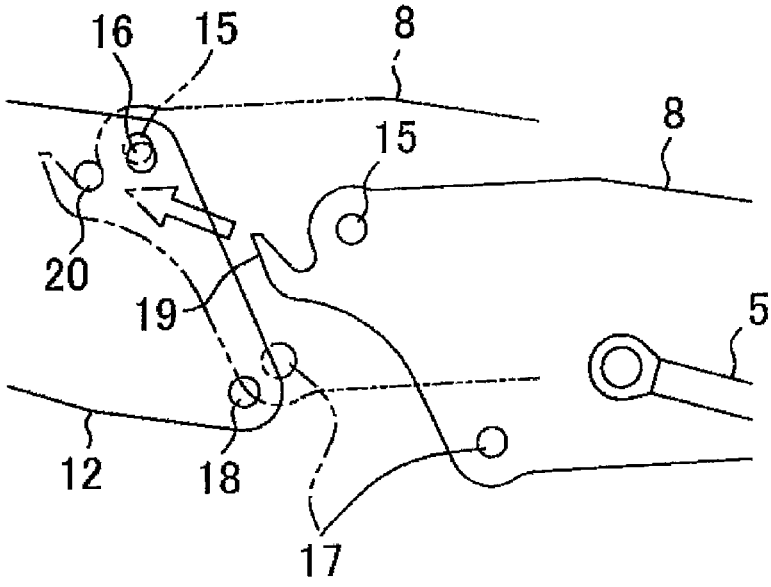
FIG. 13 PRIOR ART
FIG. 13 is a partially enlarged view of FIG. 12.
Figure 14:
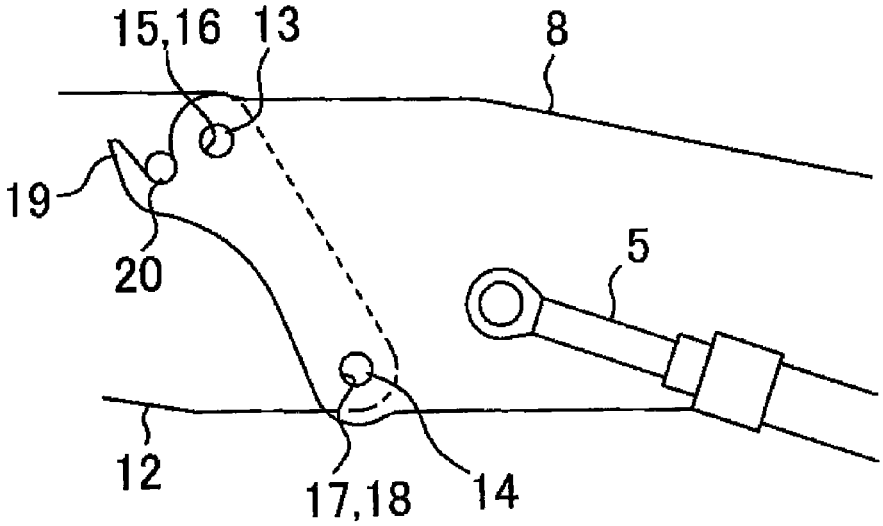
FIG. 14 PRIOR ART
FIG. 14 is a side view of a state after completing the connection.
Figure 15:
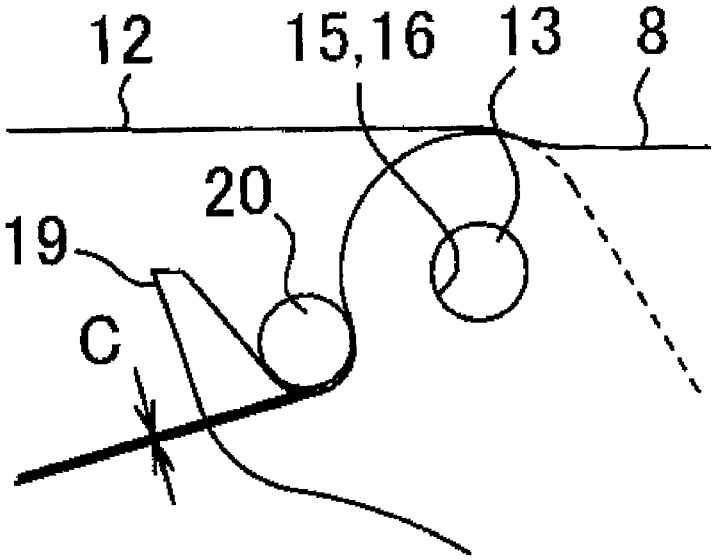
FIG. 15 PRIOR ART
FIG. 15 is a partially enlarged view of FIG. 14.

In such a case, it can be thought that the conventional technique shown in FIGS. 12 to 14 is used for connecting the above front boom body.

However, the conventional technique has a structure that relative rotation of the main boom body 8 and the extension boom body 12 is prevented by the hook 19 and the boss 20. Therefore, when the above structure is used as a structure for connecting the main boom body 8 or the extension boom body 12 and the front boom body 10, rotation of the front boom body 10 is prevented after assembling and hence the work cannot be performed.

That is, the conventional technique cannot be applied to pin hole matching at the time of connecting the front boom body, and there is no other effective conventional technique. Therefore, the pin hole matching becomes troublesome at the time of connecting the front boom body.

Figure 6:
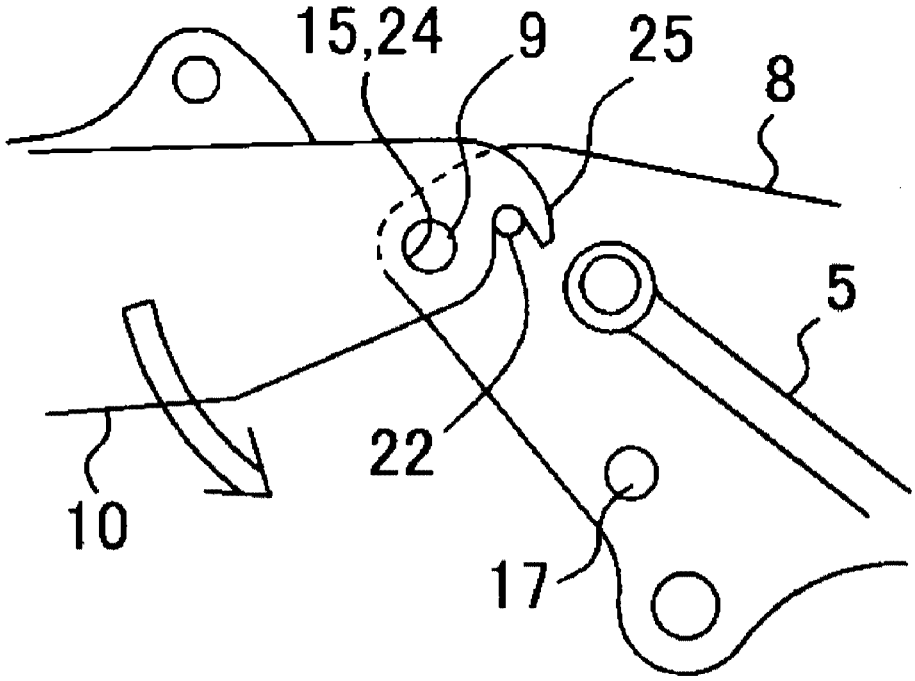
FIG. 6 is a side view showing a case where a configuration of the first embodiment is applied to a connection part of the main boom body and a front boom body.
Figure 7:
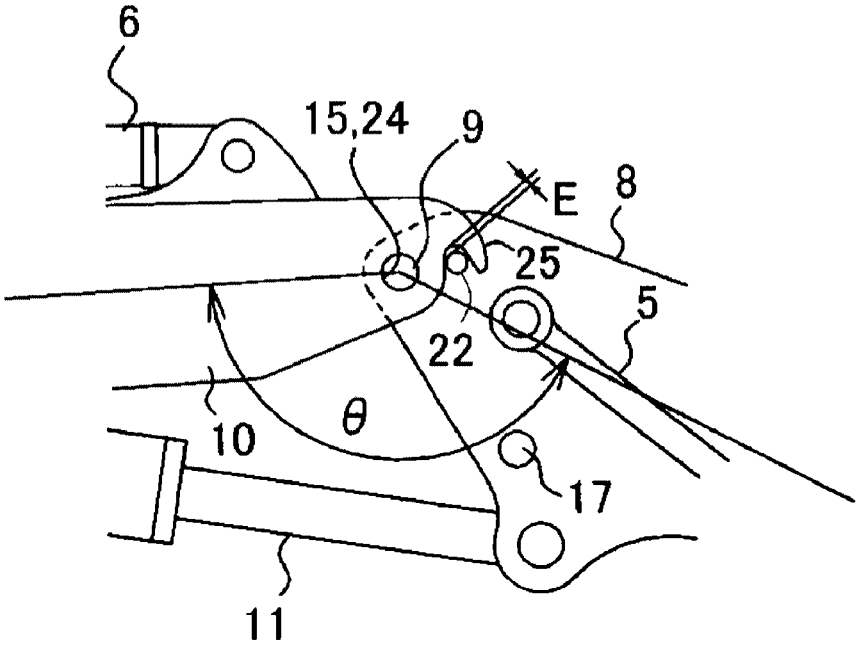
FIG. 7 is a side view showing a state that an angle between both the boom bodies is a maximum angle at the time of work by the scooping action further from the state in FIG. 6 and a second boom cylinder is attached.
Figure 8:
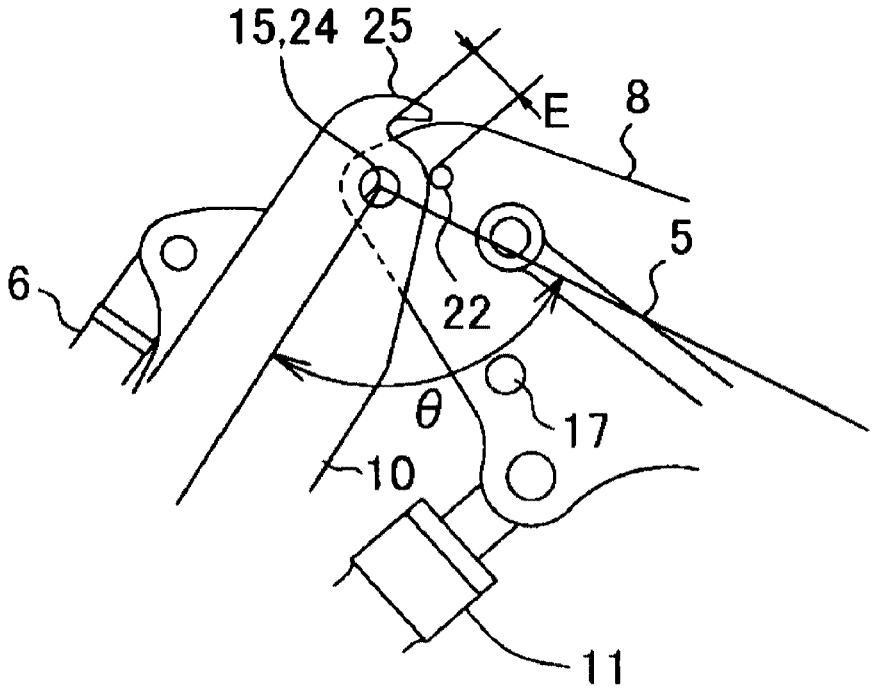
FIG. 8 is a side view showing a state that the angle between both the boom bodies is reduced from the state in FIG. 7.

FIGS. 6 to 8 show a case where a configuration of the above embodiment is applied to a structure for matching the pin holes for attaching the front boom body 10 to the main boom body 8 in the first attachment A1 having the fundamental separate specification as an example.

That is, a single pin hole 24 into which the rotation spindle 9 is inserted, and a hook 25 opening downward and corresponding to the hook 23 of the extension boom body 12 described in the embodiment are provided in a base end part of the front boom body 10. The upper pin hole 15 of the main boom body 8 and the pin hole 24 of the front boom body 10 are positioned by the above hook 25 and the boss 22 of the main boom body 8.

Operation processes in such a case are basically the same as the processes for the main boom body 8 and the extension boom body 12 described in the embodiment. That is, as shown in FIG. 6, the scooping action is performed in a state that the boss 22 is engaged with the hook 25 from the lower side, the pin holes 15 and 24 are matched with each other by rotating the front boom body 10 downward around a center of the boss, and the rotation spindle 9 is inserted into the matched pin holes 15 and 24.

Then, by further performing the scooping action, the front boom body 10 is rotated downward around the rotation spindle 9. As shown in FIG. 7, in a state that an angle θ between both the boom bodies 8 and 10 is a maximum angle at the time of work in which the front boom body 10 is rotated and folded into a reverse V shape relative to the main boom body 8, a second boom cylinder 11 is installed between both the boom bodies 8 and 10 so as to complete the connection.

In such a case, there is a need for an arrangement condition of the boss 22 and the hook 25: "in a state that the angle θ between both the boom bodies 8 and 10 is the maximum angle at the time of work, the hook 25 and the boss 22 are moved away from each other as shown in FIG. 7 (the character E in FIG. 7 denotes a clearance between the hook and the boss), and a distance (the clearance E) between the hook 25 and the boss 22 is increased as the angle θ between both the boom bodies 8 and 10 is reduced from the maximum angle as shown in FIG. 8."

By applying the configuration of the embodiment as mentioned above, even in the case where the front boom body 10 is connected to the main boom body 8 so as to be rotated and folded, it is possible to easily match the pin holes.

It should be noted that the above configuration can be applied as a configuration that the front boom body 10 is connected to the extension boom body 12 in a state that the extension boom body 12 is connected to the main boom body 8 in the second attachment A2 in FIG. 11B.

In such a case, the hook 23 engaged with the boss 22 of the main boom body 8 is provided in the base end part of the extension boom body 12, and the boss 22 engaged with the hook 25 of the front boom body 10 is provided in a front end part of the boom body 12 so as to satisfy the above conditions.

Second Embodiment

Figure 9:
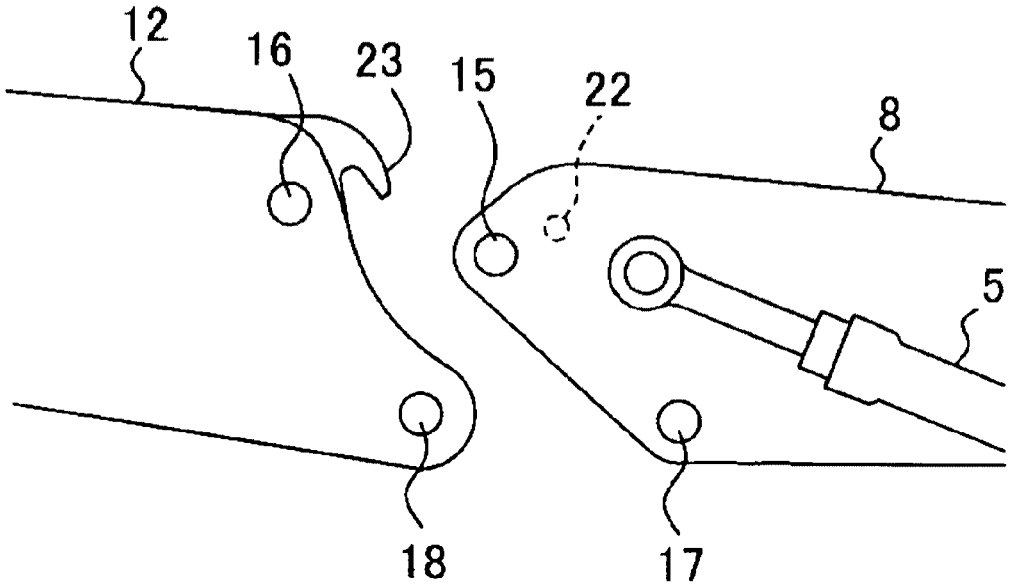
FIG. 9 is a view showing a second embodiment of the present invention and corresponding to FIG. 1.
Figure 10:
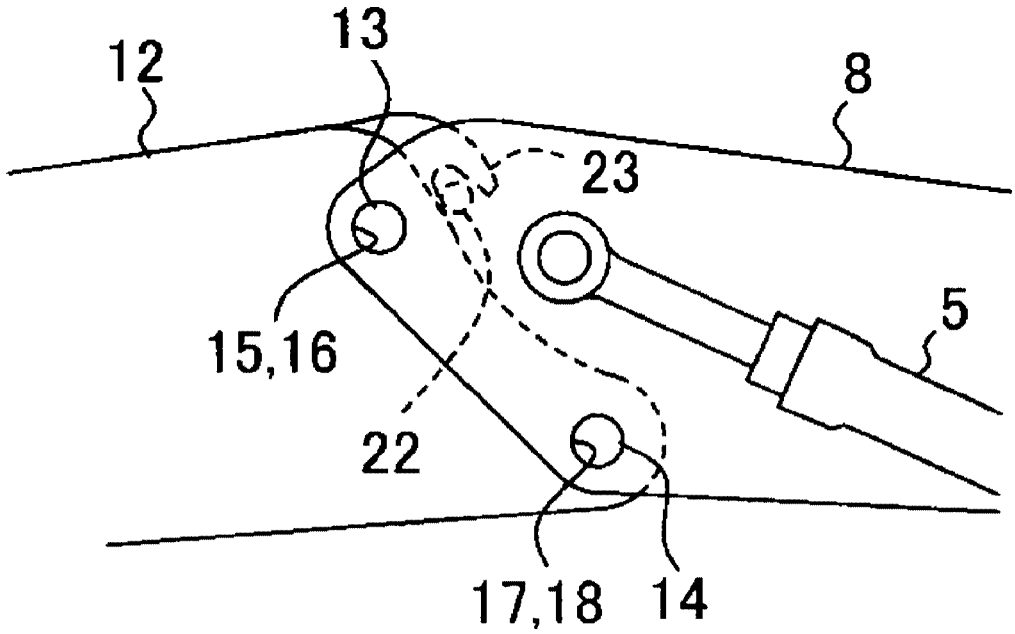
FIG. 10 is a view showing the second embodiment and corresponding to FIG. 4.

Refer to FIGS. 9 and 10

In the above embodiment, the boss 22 is provided on the outer surface of the front end part of the main boom body 8 (or the extension boom body 12). Meanwhile, the above boss 22 is provided on an inner surface of the front end part thereof in a second embodiment.

In such a case, needless to say, the hook 23 (or 25) is provided at a position corresponding to the boss 22 in the boom width direction.

According to the above configuration, it is also possible to obtain the same effects as the first embodiment. Since an engagement part between the boss 22 and the hook 23 (or 25) is positioned on the inner side of the boom, there is an advantage of preventing damage of the boss and the hook due to rubble and the like.

It should be noted that in the above embodiment, the description is given to an example that the main boom body 8 and the extension boom body are connected to each other in the second attachment A2 in FIG. 11B. However, the present invention can be applied to a connection part of extension boom bodies in the case where a plurality of extension boom bodies are connected to each other in the second attachment A2.

Although the invention has been described with reference to the preferred embodiments in the attached figures, it is noted that equivalents may be employed and substitutions made herein without departing from the scope of the invention as recited in the claims.

I claim:

1. A working machine with a structure for assembling a boom thereof, the structure comprising:

a first boom body;

a second boom body connected to a front end part of said first boom body rotated by a first boom cylinder with pin holes in each said first and second boom bodies and pins for said pin holes in both upper and lower areas of each of the first and second boom bodies, the upper and lower areas being defined when the boom is horizontal, said boom comprising the first and second boom bodies; and bosses provided in the front end part of said first boom body so as to extend in the boom width direction, wherein said bosses, and hooks formed in a base end part of said second boom body and opening downward, are arranged so as to satisfy the following conditions respectively:

(A) both said boom bodies are relatively rotated around a center of said bosses by a scooping action of rotating said first boom body upward by said first boom cylinder in a state that said bosses are engaged with said hooks, and said upper pin holes of said boom bodies are matched with each other by said above relative rotation; and (B) by rotating said first boom body upward in a state that said upper pins are inserted into said matched upper pin holes, said second boom body is rotated downward around said upper pins, and said hooks are moved away from said bosses while said lower pin holes of said boom bodies are matched with each other.

2. The working machine according to claim 1, further comprising:

a main boom body serving as said first boom body;

an extension boom body that is connected to a front end part of said main boom body attached to a base machine of the working machine and serves as said second boom body, and a front boom body connected to a front end part of said extension boom body so as to relatively rotate, wherein said bosses are provided in the base end part of said main boom body and said hooks are formed in a base end part of said extension boom body.

* * * * *